US005531337A

United States Patent [19]

Cappelletti et al.

[11] Patent Number: 5,531,337

[45] Date of Patent: Jul. 2, 1996

[54] AUTOMATED DECOUPLER FOR RAIL CARS

[75] Inventors: Joseph Cappelletti; Samir Zakaria, both of Sudbury, Canada

[73] Assignee: Inco Limited, Toronto, Canada

[21] Appl. No.: 453,785

[22] Filed: May 30, 1995

[51] Int. Cl.[6] ..... B61G 7/00

[52] U.S. Cl. ..... 213/211; 901/47

[58] Field of Search ..... 213/159, 161, 213/163–170, 211–219; 901/47, 9

[56] References Cited

U.S. PATENT DOCUMENTS

| | | | |
|---|---|---|---|
| 447,578 | 3/1891 | McKeen . | |
| 548,068 | 10/1895 | Kling | 213/160 |
| 1,028,531 | 5/1912 | Blaettnar et al. . | |
| 2,746,615 | 5/1956 | Heimaster et al. | 213/212 |
| 2,933,201 | 4/1960 | Anderson | 213/211 |
| 3,132,749 | 5/1964 | Whitehouse et al. | 213/211 |
| 3,682,325 | 8/1972 | Peterson et al. | 213/211 |
| 3,750,897 | 8/1973 | Murato et al. | 213/211 |
| 3,854,598 | 12/1974 | Yamazaki et al. | 213/75 |
| 5,139,161 | 8/1992 | Long | 213/115 |

FOREIGN PATENT DOCUMENTS

| | | | |
|---|---|---|---|
| 3819388 | 12/1989 | Germany | 213/161 |
| 0787227 | 12/1980 | U.S.S.R. | 213/211 |
| 0872352 | 10/1981 | U.S.S.R. | 213/211 |
| 1211125 | 2/1986 | U.S.S.R. | 213/211 |
| 1341085 | 9/1987 | U.S.S.R. | 213/162 |
| 1736797 | 5/1992 | U.S.S.R. | 213/211 |

*Primary Examiner*—Mark T. Le
*Attorney, Agent, or Firm*—Edward A. Steen

[57] ABSTRACT

There is provided an automated rail car uncoupling system that reduces the possibility of injury. The system includes an object locator that detects and locates a locking pin actuator associated with a coupler. Upon confirmation of the location of the actuator, a robot reaches over and moves the actuator thus uncoupling the cars.

15 Claims, 3 Drawing Sheets

AUTOMATED DECOUPLER FOR RAIL CARS

TECHNICAL FIELD

The instant invention relates to the uncoupling of rail cars in general and, more particularly, to an automated system for decoupling rail cars. The system is particularly adapted to operate in conjunction with a rail car positioner.

BACKGROUND ART

Conventional railway car couplings, both freight and passenger, generally consist of two opposed, cooperating, knuckle-like clamps affixed to the ends of the cars. When engaged, the clamps are in intimate relationship with one another. Most designs utilize a vertical, movable locking pin that locks and unlocks the clamps.

In order to uncouple the cars, the locking pin of one clamp is usually raised up a predetermined vertical distance so as to unlock the clamp of the coupling pair. The clamp opens and allows the knuckle to release its hold on the corresponding knuckle, thereby freeing the cars from one another.

Typically, the uncoupling operation is conducted manually. A conductor first engages a lever affixed to the car and the locking pin with a long bar. He then pulls upwardly on the bar moving the lever and thus disengaging the couple.

Manual uncoupling is a dangerous occupation. In crowded and noisy environments, working about and around rolling stock is fraught with risk.

Automatic uncoupling systems have been proposed over the years to reduce the risk of injury and expedite the movement of rail vehicles.

Many of these systems appear to employ dumb, set position hydromechanical devices that cannot accommodate variations in car position. Over a period of time, car placement vis-a-vis the uncoupler may change thereby rendering these systems inoperative. Vigilant efforts must be used to insure that the cars are repeatedly placed exactly in the correct location every time uncoupling is contemplated. Examples include U.S. Pat. Nos. 3,854,598; 3,750,897; 3,682,325; 3,132,749 ; and 1,028,831.

Alternative variations include car mounted decouplers such as U.S. Pat. Nos. 5,139,161; 2,796,615 and 447,578. These apparatus appear to be somewhat complex, probably expensive, and apparently are not suitable for large numbers of standard rail vehicle applications.

SUMMARY OF THE INVENTION

Accordingly, there is provided an automated system for uncoupling rail cars with little or no human interaction.

The invention consists of a robot arm guided by an object locating system. The object locating system identifies and indexes the joined coupling and positions the robot arm to lift up the locking pin. An associated rail car positioner moves the car to a selected position.

PREFERRED MODE FOR CARRYING OUT THE INVENTION

The objective of the instant invention is the creation of an automatic decoupling system 10 for rail cars. The thrust of the system is to remove personnel from a dangerous environment. The manual decoupling of rail cars by conductors is a dangerous operation. The conductors must manually enter into the coupling zone to free the cars. Moving cars, noise and blind spots can result in accidents.

Figure 1:
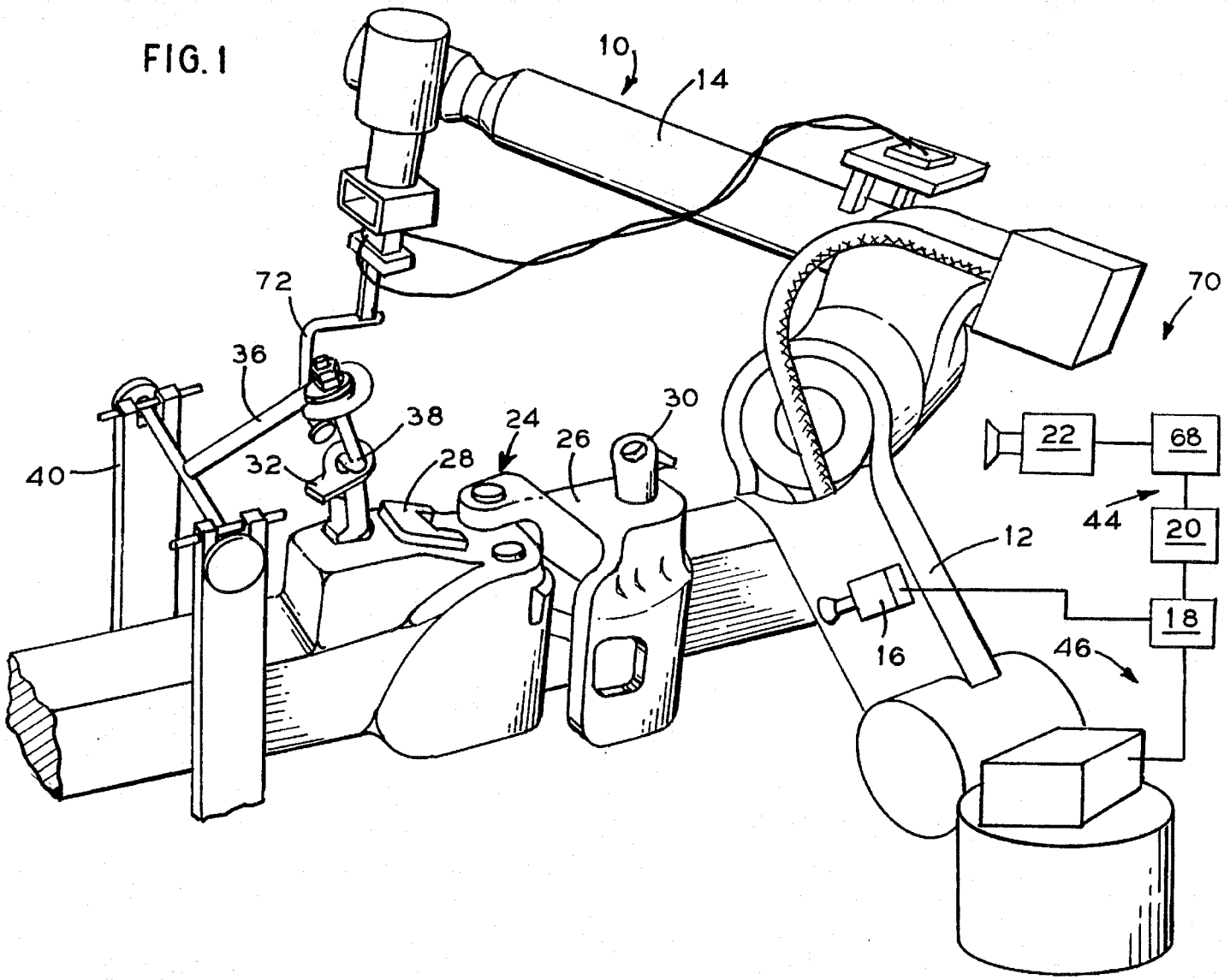
FIG. 1 is a view of an embodiment of the invention.

As shown in FIG. 1, an object locating system 70 includes a robot 12 having an articulated robotic arm 14, a first camera 16, a robot controller 18, a programmable logic controller (PLC) 20, a second camera 22, and a sensing unit 68.

FIG. 1 depicts a successful laboratory prototype decoupler 10. Coupling 24 is a conventional rail car coupling consisting of two opposed engagable knuckle clamps 26 and 28. Either clamp 26 and 28 may be disengaged by the partial withdrawal of locking pins 30 and 32. Locking pins may be found on the top or on the bottom of the clamps. Upper pins are more common.

Only one pin 30 or 32 need be withdrawn to uncouple the clamps 26 and 28.

Figure 2:
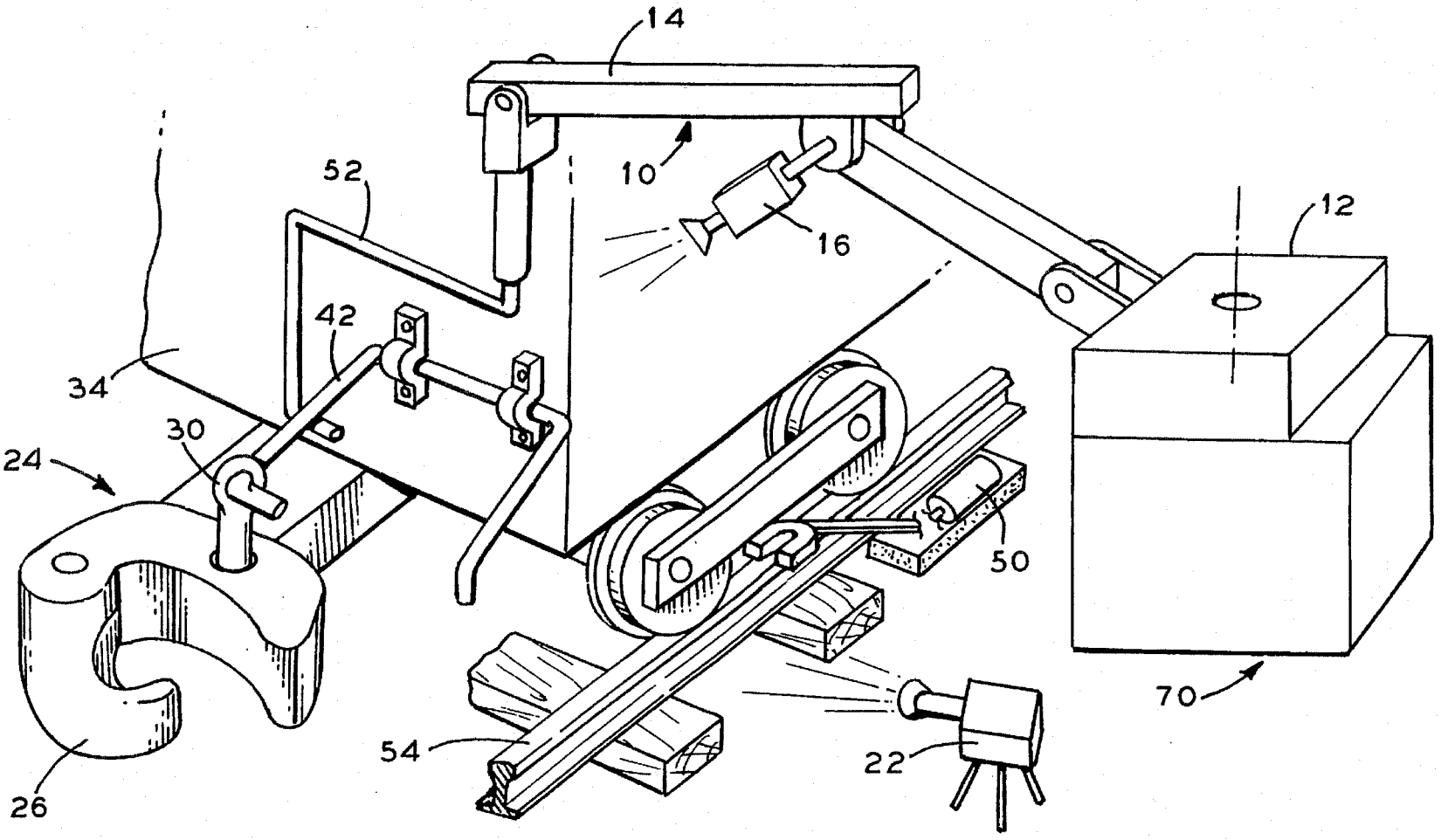
FIG. 2 is a view of an embodiment of the invention.

For laboratory purposes, the clamps 26 and 28 were mounted on wheeled stands 40 to allow for the engagement and disengagement of the coupling 24. Under normal circumstances, the clamps 26 and 28 are mounted to rail cars. A single rail car 34 having the clamp 26 is shown in FIG. 2.

Returning to FIG. 1, an actuator arm 36 is affixed to a hook 38 inserted into the locking pin 32. For laboratory purposes, the actuator arm 36 is pivotally mounted to the stand 40. The arm 36 is analogous to a rail car lever 42 as shown in FIG. 2.

The decoupling system 10 operating through the object locator 70 is designed to locate the position of the coupling 24 in space and then act upon it by means of the first camera 16 and the robot 12 comprising a robotic vision system 46 and/or the second camera 22 connected to the sensing unit 68 and the PLC 20 comprising a vision sensor system 44. The decoupler 10 is specifically capable of determining small variations in the position of the coupling 24, correcting for them, and still managing the uncoupling operation for each. successive iteration.

In a one embodiment, the object locator 70 is comprised of the first camera 16 connected to the robot controller 18 comprising the robotic vision system 46. A personal computer board (not shown) is plugged into the backplane of the controller 18. The controller 18, supplied by the robot's manufacturer and programmable in-house, is sophisticated enough to recognize the coupling's position and lift up the locking pin 32.

In this instance, a Nachi™ Robotics Model 7603, rack mounted, six axis robot 12 was successfully used. Initially, the camera 16 takes a picture of the locking pin 32 and the arm 36. This snap shot image is stored in the robot's controller 18 as a previously identified coupling value. The robotic vision system 46 then hunts for the received image of the pin/lever combination received by the camera 16 with the initialized memory. The controller 18 continuously compares the received image and the snap shot image by moving the robot arm so as to superimpose the two images. Upon recognizing a suitable match, the controller 18 instructs the robot 12 to reach over to the arm 36 and pull it up via hook 72. The clamp 28 is opened and the coupling 24 is disengaged.

As an independent or redundant system, the second camera 22 is associated with the robot 12. In this instance, the object locator 70 is the vision sensor 44 comprised of the second camera 22 and the associated sensing unit 68 carded into the PLC 20.

The sensing unit 68 may be an Itran™ Corporation Model M-MS41-201 (Manchester, N.H.) vision sensor which is used to verify the presence, correctness and exact location of the locking pin 32. The sensing unit 68 translates the two dimensional image recorded by the second camera 22 into a gray-scale image matrix that detects dimensions, edges and is able to identify object features.

As is understood, the Itran sensing unit 68 (or similar unit) was developed to optically scan products sequentially moving past a fixed site. Used for quality control purposes, the system measures dimensions, verifies tolerances and detects flaws in products as they are manufactured. For the instant invention, the vision system 44 was adapted to seek out the locking pin 32 as it comes into view and direct the robotic arm 14 to locate the actuator arm 36 or the lever 42, lift the component up to uncouple the clamps 26 and 28, clear the coupling 24 and then reset the robot 12 for the next operation.

The sensing unit 68 is essentially a measuring system that looks for identified edges in its field of view. When it detects edges, it conducts distance measurements between an arbitrary zero setting comprising a first stored edge and the second edge of the received object. The width of the locking pin 32 is a known constant. As a consequence, an edge of the locking pin 32 may be stored as a previously identified coupling value. By measuring the distance between the known pin edge location and the corresponding, camera image of the viewed pin, the differential "X offset" distance may be determined. When the difference between the previously identified coupling value, in this case the selected parameter pin edge distance, and the X offset becomes zero, a match is made and confirmed; the resulting activation signal is then fed to the PLC 20 which in turn instructs the robot 12 by a conventional RS232 serial communications link or similar device. As a consequence, the robot 12 is energized by the robot controller 18 to lift the pin 32, free the coupling and return to a reset position.

The robotic vision system 46 and the vision sensor 44 comprise the overall object locator 70 either singularly or in combination.

Although each system 44 and 46 may operate independently, it is preferred to operate them in tandem with one system backing up the other in the event of a view obstruction, component failure or the like. When operated in the dual mode, the PLC 20 further compares the output from the vision sensor system 44 and the robotic vision system 46. If they are in agreement, the robot 12 is energized. If there is a disagreement, either system, either 44 or 46, may be designated to take over in a default mode or the system 10 may be shut down. In the laboratory prototype pictured in FIG. 1, the vision system 44 was used as a secondary system backing up the robotic system 46.

As one skilled in the art will appreciate, each site specific application of the decoupling system 10 will require its own set of software parameters. Much of the basic proprietary software is available from the manufacturers. However, it is up to the purchaser to set up and operate the system 10 as needed. For example, in the embodiment shown in FIG. 1, the prototype decoupling system 10 was operated in a laboratory. Due to the custom nature of the system 10, a Modicom™ PLC 20 utilized an in-house programmed Taylor™ 984/584 ProWorx™ Plus System Programmer software. Copies of the software drivers utilized for the prototype are available from the inventors.

FIG. 2 depicts the decoupler 10 in a typical field location. For simplicity, the robot 14 is shown in a schematic representation. In one embodiment, the instant invention is contemplated for use with a large ore tipple 48. Trains of loaded cars 34 are pushed onto a rail car positioner 50. The positioner 50 utilizes hydraulic cylinders to grasp a car axle, propel the car and then position the car in a predetermined location. A non-limiting example of such a positioner 50 is a StephensAdamson (Canada) Nolon HCM car spotter (Belleville, Ontario).

Figure 3:
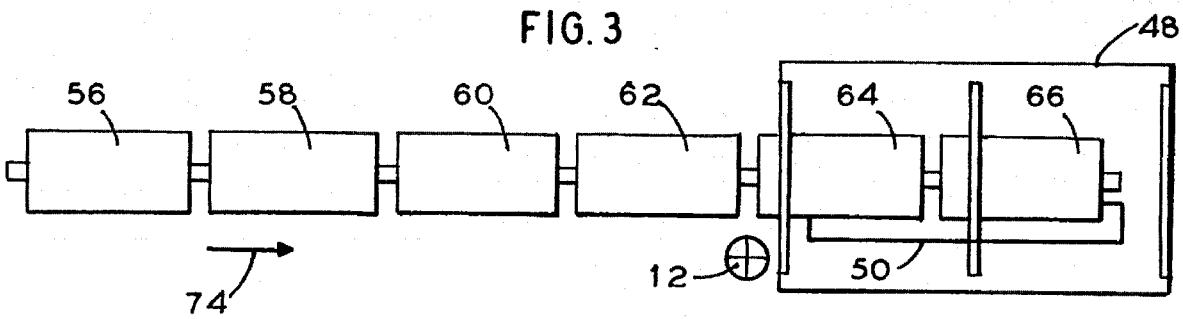
FIGS. 3, 4, and 5 are plan views depicting operating steps involving the invention.

For purposes of clarity, only one car 34 is shown in FIG. 3. The robot 12 is located adjacent to the tracks 54. The car 34 is propelled to a predetermined uncoupling site whereupon the decoupling system 10 verifies the location of the lever 42. Levers 42 may be car mounted (as shown) or clamp mounted.

Upon initialization, the robot arm 14 is extended over to the lever 42. Receiving images from the one or both cameras 16 and 22, the robotic vision system 46 and/or the vision sensor system 44 connected to the PLC (not shown) guide the robot 14 to engage the lever 42 at any location. An appropriately shaped hook 52 affixed to the robotic arm 14 contacts the lever 42 and is pulled up. The lever 42 simultaneously lifts up the locking pin 30 and frees the clamp 26.

The decoupling system 10 then disengages the hook 52 from the lever 42 and returns the arm 14 to a rest position away from the tracks 54. The software in the object locator 70 then resets the arm 14 so as to anticipate and read the next car coupling 24 as it is brought into view.

The decoupling system 10 is sophisticated enough to recognize the coupling 24, pin 30 or lever 42 and any variation in the final position of the selected coupling components. This permits the decoupler 10 to account for any small perturbances in the final positioning of the cars 34 prior to their disengagement by hunting for the targeted component.

Figure 4:
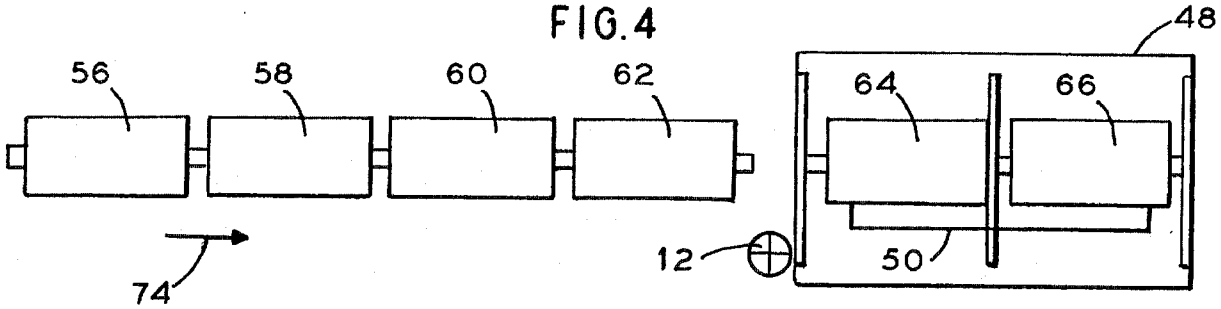
Figure 5:
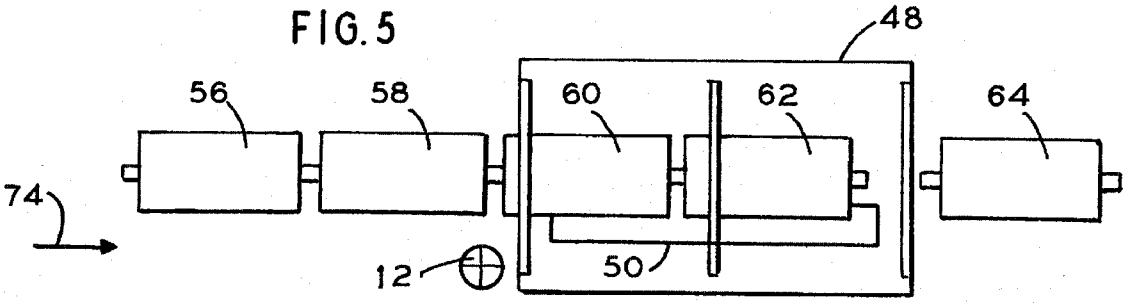

FIGS. 3–5 depict a series of plan views showing sequential operations involving the decoupler 10.

A train of cars 56–66 is brought to the tipple 48 with the coupling between cars 62 and 64 positioned in the uncoupling site in the vicinity of the robotic arm 14. The decoupling system 10 causes the robot 12 to locate and pull a lever freeing the cars 64 and 66 from the rest of the train. The car positioner 50 then propels the cars 64 and 66 in direction 74 onto the tipple 48 as shown in FIG. 4. The tipple 48 dumps the contents of the cars 64 and 66 and the car positioner 50 extracts the now empty cars 64 and 66. The entire sequence may then be repeated with the next pair of cars 60 and 62 placed in front of the robot 12 for uncoupling.

While in accordance with the provisions of the statute, there are illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. An automated system for uncoupling coupled cars having a shared coupling therebetween, the coupling having opposed engagable clamps, the engagable clamps having locking pins, and means for moving the locking pins, the automated system comprising an object identifying system adapted to: 1) identify at least one component of the coupling, 2) compare the identified component of the coupling with previously identified coupling values, and 3) locate the position of the locking pin moving means, a robot responsive to the object identifying system for actuating the locking pin moving means, and means for separating the resultant uncoupled cars.

2. The system according to claim 1 wherein the object identifying system comprises a robotic vision system including a first image receiving apparatus, a robot controller connected to the image receiving apparatus and the robot, and means for coordinating the robot's actions responsive to the images received by the first image receiving apparatus vis-a-vis the previously identified coupling values.

3. The system according to claim 2 wherein a previously identified coupling value is an image of a component of the coupling.

4. The system according to claim 1 wherein the object identifying system comprises a vision sensor system including a second image receiving apparatus, a measuring system utilizing a gray scale field of view edge coordinate finder, and means for coordinating the robot's actions responsive to the images received by the second image receiving apparatus and the edge coordinate finder vis-a-vis the previously identified coupling values.

5. The system according to claim 4 wherein a previously identified coupling value is an image of a component of the coupling.

6. The system according to claims 2 or 4 including the robotic vision system and the vision sensor system.

7. The system according to claim 1 wherein the robot includes a hook for engaging the pin moving means.

8. The system according to claim 1 including a car positioner.

9. The system according to claim 1 including a programmable logic controller adapted to receive intelligence from the object identifying system and operate the robot.

10. The system according to claim 2 including a programmable logic controller adapted to coordinate intelligence from the object identifying system and the robotic vision system and operate the robot.

11. An automated method for uncoupling cars, the cars having opposed engagable clamps forming a couple therebetween, a locking pin associated with a clamp, an actuator for moving the locking pin, and means for locomoting the cars, the method comprising:

a) situating an object identifier and robot near a predetermined site for uncoupling cars;

b) routing a coupled car pair to a site adjacent to the robot;

c) the object identifier detecting the presence and location of the actuator;

d) instructing the robot to seek out the actuator and causing the actuator to move;

e) unlocking the locking pin;

f) uncoupling the cars; and g) separating the cars.

12. The automated method according to claim 11 comprising a robotic vision system including storing an image of an actuator in a memory associated with the robot, comparing the stored image of the actuator with a second actual car actuator viewed by an image receiving device associated with the object identifier, causing the robot to find the second actual car actuator based upon the previously referenced comparison step, and causing the robot to move the second actual car actuator thereby uncoupling the cars.

13. The automated method according to claim 11 employing a vision sensor system including storing a first image of a car actuator in a gray scale memory apparatus and of a predetermined actuator edge, establishing the first image as a fixed value, viewing an actual car actuator by means of a second image receiving device associated with the object identifier, comparing an actual edge from the actual actuator with the fixed value, causing the robot to seek out the actual edgo of the actual car actuator by measuring a diminishing difference between the fixed value and a gray scale image of the actual edge as received by the second image receiving device, and causing the robot to move the actuator and uncouple the cars.

14. The automated method according to claims 12 or 13 including coordinating the robotic vision system and the vision sensor system to uncouple the cars.

15. The automated method according to claim 11 including a rail car positioner separating the uncoupled cars.

* * * * *